United States Patent [19]

Lucia

[11] 4,157,793

[45] Jun. 12, 1979

[54] BOBBIN WINDING SYSTEM

[75] Inventor: Jack S. Lucia, Fair Lawn, N.J.

[73] Assignee: Independent Machine Company, Paterson, N.J.

[21] Appl. No.: 821,755

[22] Filed: Aug. 3, 1977

[51] Int. Cl.[2] ..... B65H 54/20

[52] U.S. Cl. ..... 242/35.5 R; 242/43 R; 242/46.2; 242/68.3; 242/157 R

[58] Field of Search ..... 242/35.5 R, 32, 43 R, 242/157 R, 68.3, 46.2

[56] References Cited

U.S. PATENT DOCUMENTS

| | | | |
|---|---|---|---|
| 916,388 | 3/1909 | Clark | 242/35.5 R |
| 1,146,452 | 7/1915 | Rotter | 242/35.5 R |
| 1,179,924 | 4/1916 | Howell | 242/68.3 |
| 1,357,470 | 11/1920 | Perry | 242/35.5 R |
| 2,177,373 | 10/1939 | Newton et al. | 242/35.5 R X |
| 2,622,818 | 12/1952 | Faris et al. | 242/46.2 |
| 2,888,215 | 5/1959 | Genovese, Sr. et al. | 242/35.5 R |
| 2,889,577 | 6/1959 | Winer | 242/35.5 R X |
| 4,062,503 | 12/1977 | Chaplin, Jr. et al. | 242/35.5 R |

FOREIGN PATENT DOCUMENTS

| | | | |
|---|---|---|---|
| 280489 | 11/1914 | Fed. Rep. of Germany | 242/35.5 R |
| 2207770 | 8/1972 | Fed. Rep. of Germany | 242/35.5 R |
| 25374 | 7/1973 | Japan | 242/35.5 R |

*Primary Examiner*—Stanley N. Gilreath
*Attorney, Agent, or Firm*—Mason, Fenwick & Lawrence

[57] ABSTRACT

A thread winding system has a rectangular hollow central support column housing having front and rear panels through which a plurality of bobbin support shafts extend and are supported for rotation; the shafts are arranged in horizontal and vertical rows and each includes a friction drive member and a pivot latch means on its extreme outer end for maintaining a bobbin in position on each end of the shaft to be drivingly rotated. Thread guide frames each consisting of unitarily connected vertical and horizontal rods extending between the vertical and horizontal rows of bobbin supporting shafts are provided adjacent the front face and the rear face of the supporting column and are reciprocated by a rotating barrel cam on the interior of the support column with guide means on the frame guiding individual threads to a respective one of the bobbin members. A chain drive system on the interior of the support column drives the shafts and the barrel cam. An alternative construction employs a pivotal latch member on the end of each shaft with a roller engaging the bobbin end face to hold the bobbin in position against the urging of the spring urged friction drive means.

14 Claims, 14 Drawing Figures

Fig-1
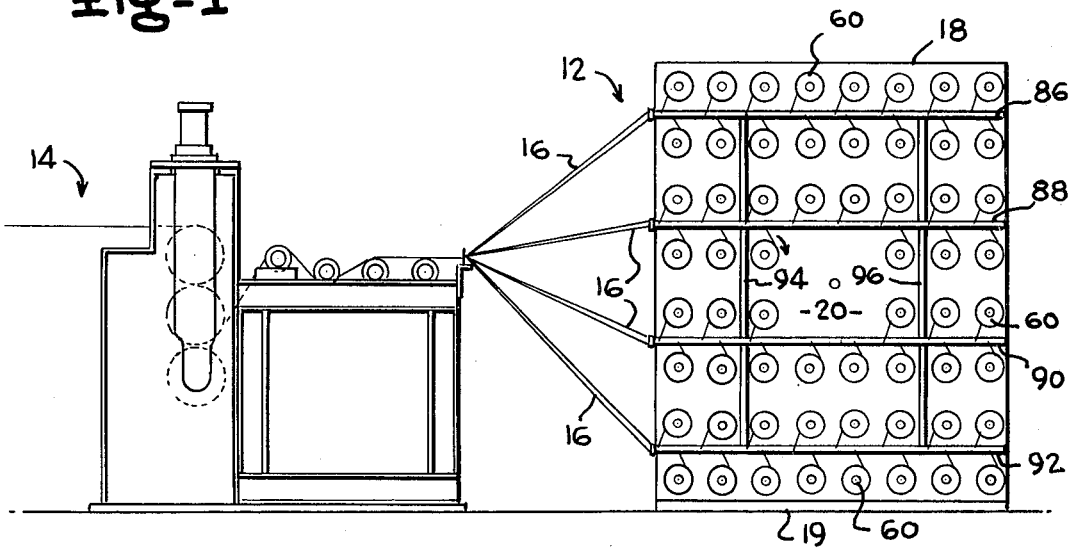
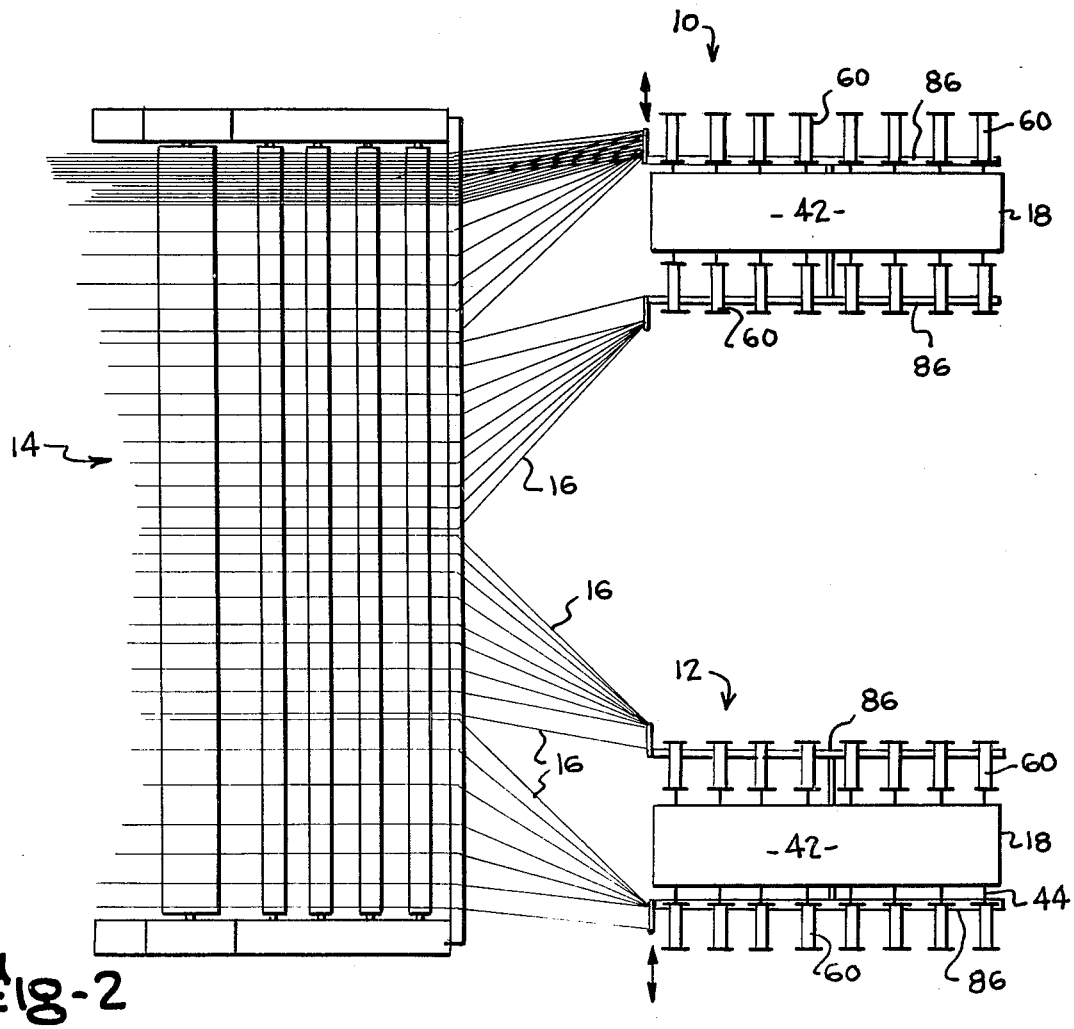
Fig-2

5
60
40
48
52
44
54
26
- 43 -
204
22
20
46
202
200
106
102
88
114
-116-
118
117
120
110
90
194
180
192
27
191
170
190
24
150
210
130
19
56
58

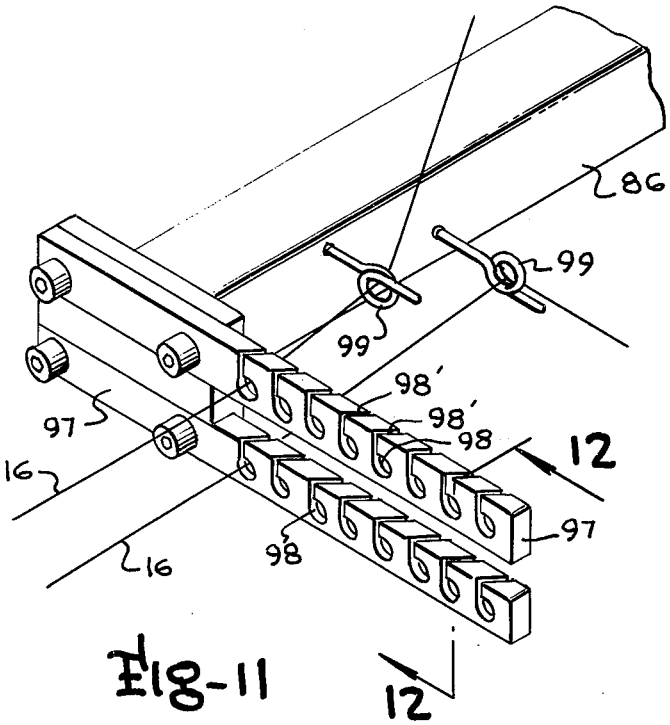
Fig-11
Fig-12
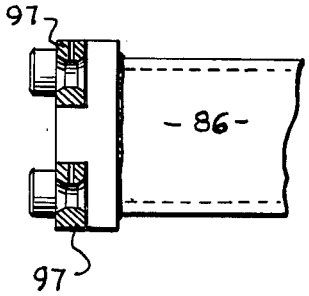
Fig-13
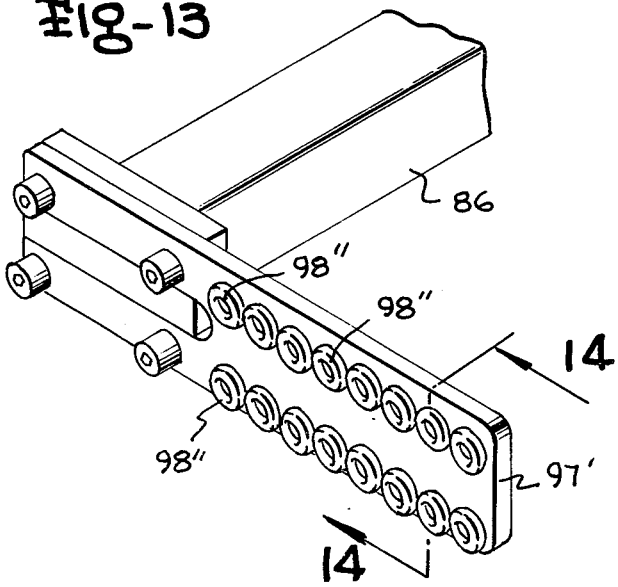
Fig-14
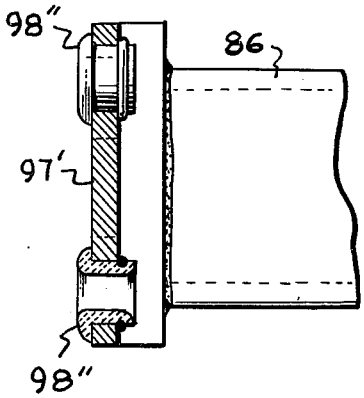

BOBBIN WINDING SYSTEM

This invention is in the field of winding and reeling of elongated, flexible threads, wires, tapes and the like and is more specifically directed to a new and improved bobbin winding system providing substantial advantages over prior known devices in this field.

Power driven bobbin winders have been employed in the textile and related fields for many years; however, the previously known bobbin winders have suffered from a number of deficiencies and shortcomings and have in general failed to keep pace with advances in the associated thread supply source equipment providing thread to be wound on the bobbin system. For example, the thread output rate of many modern thread supplying devices exceeds the winding capability of previously known bobbin systems.

Another problem with prior bobbin systems is that they occupy large amounts of both vertical and horizontal space. For example, the most common prior known bobbin winding systems, which is commonly referred to as a "stadium step winder", comprises a stepped arrangement of horizontal rows of driven bobbin members each arranged with its axis in a common vertical plane with each row of bobbins being positioned in a different horizontal plane and a different vertical plane. In this arrangement the row of bobbins closest to the supply source is at the lowest level with each succeeding row being one step upward and to the rear in the manner of stair steps. The foregoing arrangement, which is standard in literally thousands of installations, occupies a substantial amount of floor and volumetric space in an extremely inefficient manner. Moreover, the arrangement of the bobbins is such that the thread supply source must be spaced several feet from the bobbin winding system with the intervening space through which the thread travels obviously being unusable for any other purpose. Consequently, the amount of floor space required by the system is further increased by the very nature of the bobbin winding system which requires the foregoing space consuming positioning of the associated supply equipment.

Therefore, it is the primary object of this invention to provide a new and improved bobbin winding system.

A further object of the invention is the provision of a new and improved bobbin winding system providing improved space utilization efficiency.

Achievement of the foregoing objects is enabled by the preferred embodiment of the invention through the provision of a vertically extending hollow but rigid support column in the form of a housing of rectangular configuration having front and rear wall faces. The interior of the support column housing encloses various drive components and a plurality of bobbin support shafts extend through the housing with each shaft having two shaft end portions; one of the shaft end portions designated a front end shaft portion extends outwardly in a cantilever manner from the front face of the support column and the other shaft end portion which is designated a rear end shaft portion extends rearwardly in a cantilever manner from the rear face of the support column housing. The front end shaft portions and the rear end shaft portions respectively support a front bank of bobbins and a rear bank of bobbins. The bobbins of each bank are arranged in a series of vertical rows all positioned in a common vertical plane and are also arranged in a series of horizontal rows.

A front thread guide support frame is positioned for movement adjacent the bobbins of the front bank and is supported for reciprocating movement in a direction perpendicular to the front face of the supporting column and parallel to the axes of the spindle supporting shafts with a rear thread guide support frame being mounted for reciprocation in an identical manner adjacent the bobbins of the rear bank of bobbins.

The thread guide support frames are provided with a plurality of individual thread guides such as pig tail guide elements of the type well known to those of skill in the art with one such guide element being positioned on the frames adjacent each of the respective bobbins for guiding thread to the bobbin. Drive means on the interior of the vertical support column housing includes a barrel cam which serves to reciprocate the thread guide support frame by a cam follower connected to the frames for moving the frames inwardly and outwardly with respect to the housing with a chain power transmission acting to rotate the bobbin support shafts for effecting a level winding of the thread onto the bobbins carried on the shafts.

The foregoing arrangement occupies a minimum amount of space and the thread supply source can be positioned closely adjacent one edge of the system to provide for a further reduction in the required space. All of the drive components for both the thread guide frames and the spindles are positioned on the interior of the vertical column housing to provide a safe operation presenting practically no safety hazard to users of the system.

A better understanding of the manner in which the preferred embodiment achieves the foregoing and other objects of the invention will be enabled when the following written description is considered in conjunction with the appended drawings in which:

FIG. 1 is a front elevation view of a bobbin winding system embodying the preferred embodiment of the invention and including a thread supply source;

FIG. 2 is a top plan view of the system of FIG. 1;

FIG. 11 is an enlarged perspective view of a portion of the main thread infeed guide frame means;

FIG. 12 is a sectional view taken along lines 12—12 of FIG. 11;

FIG. 13 is a perspective view of a second embodiment of the main thread infeed guide frame means; and FIG. 14 is a sectional view taken along lines 14—14 of FIG. 13.

Attention is initially invited to FIGS. 1 and 2 of the drawings which illustrate two bobbin winding devices 10 and 12 of identical construction embodying the preferred embodiment of the invention and associated with a conventional thread supply and feeding device 14 which provides a continuous supply of threads 16 in a well known manner.

Figure 4:
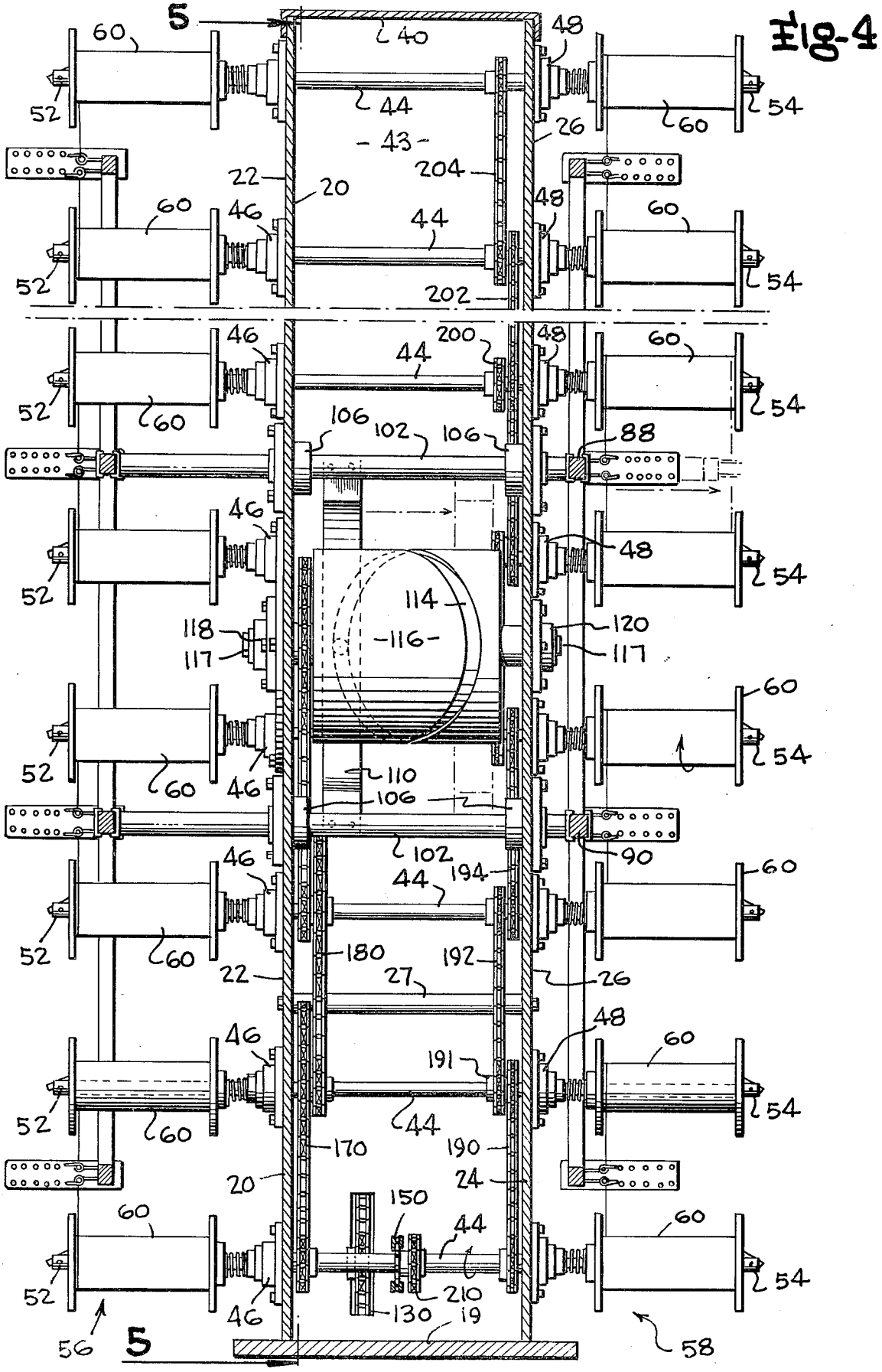
FIG. 4 is a sectional view taken along lines 4—4 of FIG. 3.
Figure 5:
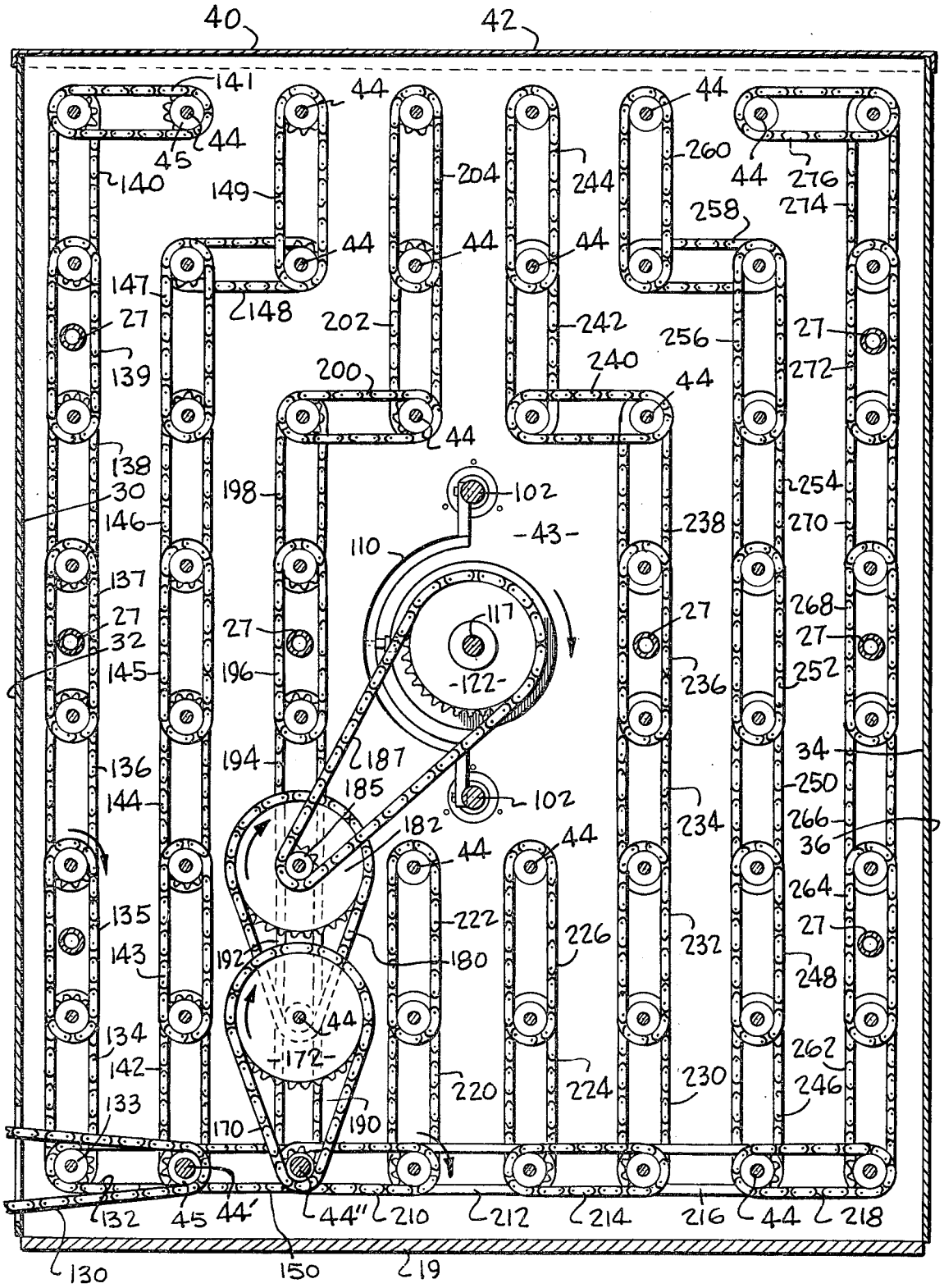
FIG. 5 is a sectional view taken along lines 5—5 of FIG. 4.

Each of the bobbin winding devices comprises a central support housing 18 best illustrated in FIGS. 4 and 5 formed of metal plate including a rigid base plate 19, a front panel 20 defining a front face 22, a rear panel 24 defining a rear face 26, a first side panel 30 defining one end face 32, a second side panel 34 defining a second side face 36, and a removable top panel 40 having a top face 42. Spacers 27 extend between front panel 20 and rear panel 24 and all of the panels forming the support column housing 18 provide a closed internal chamber 43 in which drive components of the device are mounted in a protective manner to be discussed hereinafter.

A plurality of bobbin support shafts 44 are mounted on and extend through the supporting housing 18 with each shaft being supported by a rotary support bearing 46 mounted on the front panel 20 and an identical rotary support bearing 48 mounted on the rear panel 24. Each of the bobbin support shafts 44 consist of a central portion positioned between the front and rear panels in the internal chamber 43 and a front outer end portion 52 and a rear outer end portion 54 respectively extending in a cantilever manner forwardly and rearwardly of the front and rear panels 20 and 24. Outer end portions 52 and 54 respectively provide support for a front bank 56 and rear bank 58 of bobbins 60.

Figure 7:
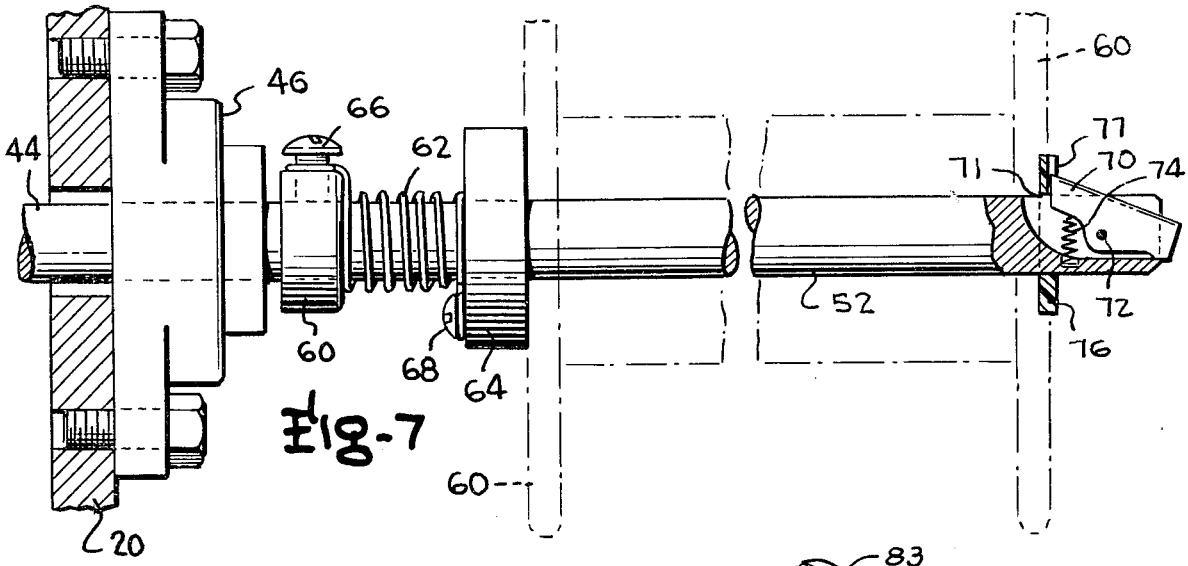
FIG. 7 is a side elevation view of a bobbin support shaft of the preferred embodiment with a portion in section for purposes of illustration.
Figure 9:
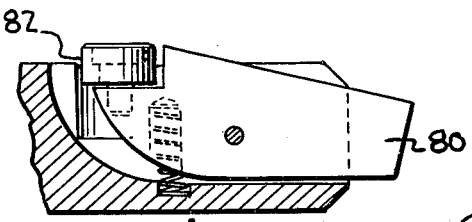
FIG. 9 is a side elevation view partially in section of a second embodiment of the bobbin supporting end shaft portion.
Figure 8:
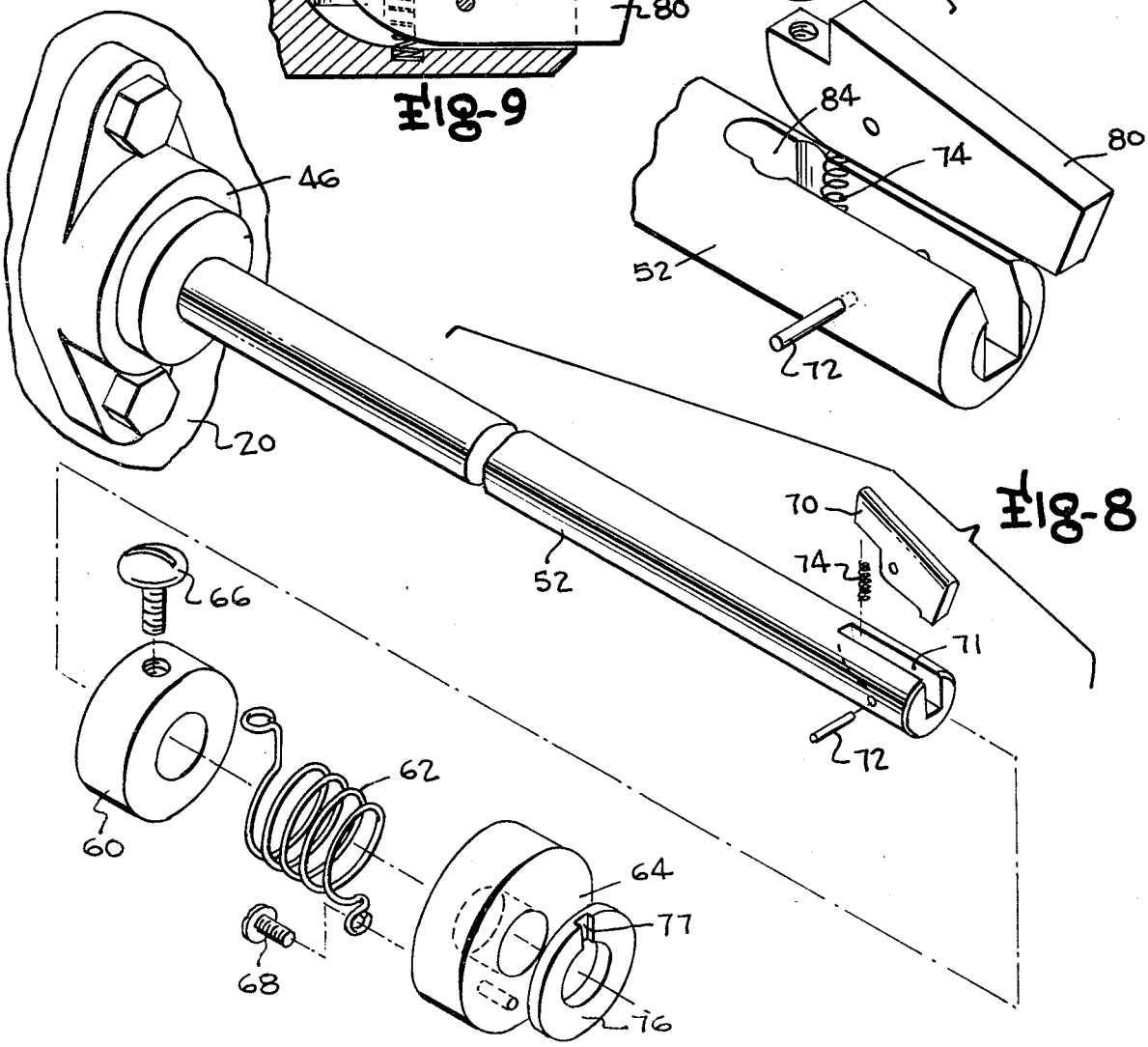
FIG. 8 is an exploded perspective of the components illustrated in FIG. 7.

FIGS. 7 through 9 illustrate the manner in which bobbins 60 of the front bank 56 of bobbins are mounted on the outer end portions 52 of shafts 44 and it is to be understood that the bobbins 60 of the rear bank 58 on the opposite outer end portions 54 of shaft 44 are mounted in exactly the same manner. FIGS. 7 and 8 illustrate means for use in winding thread or wire under heavy tension. Specifically, a collar 60 is fixedly connected to the outer end portion 52 with a compression spring 62 extending outwardly of the collar about the surface of the shaft and engaging a friction disc 64 supported for axial reciprocation on the shaft. Screw members 66 and 68 respectively connect the compression spring 62 to the collar 60 and the friction disc 64 so that rotation of the shaft is imparted to the friction disc 64 in an obvious manner. A pivotal bobbin latch 70 is mounted in a recess 71 at the outer end of shaft end portion 52 for pivotal movement about a pin 72 with a small compression spring 74 urging the latch 70 in a clockwise direction. The bobbin is positioned on the shaft by simply being axially moved over the latch 70 which pivots in a counter-clockwise direction until the end of the bobbin clears the latch 70 at which time the latch 70 is snapped into the position illustrated in FIG. 7 so as to engage a nylon wear block 76 having a slot 77 receiving the end of latch 70 to retain the bobbin position. The bobbin can be removed by manually depressing the end of the latch 70 to permit the bobbin to then be slidingly removed from the end of the shaft. It will be appreciated that the compression spring 62 urges the friction disc 64 against the opposite end of the bobbin so that rotation of the shaft 44 is imparted to the bobbin via means 60,62 and 64 in an obvious manner.

Figure 10:
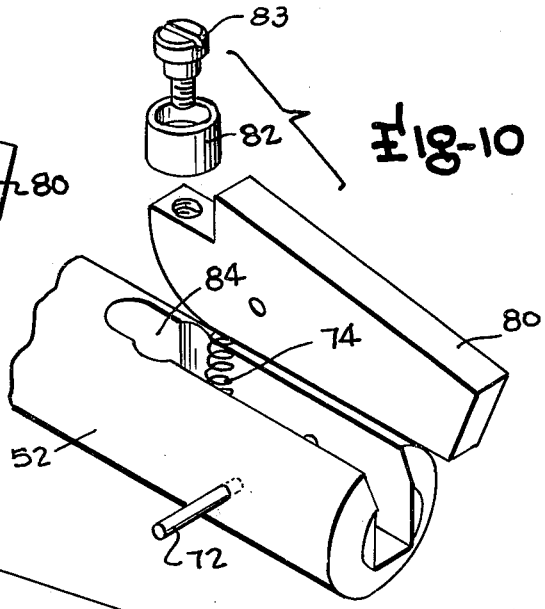
FIG. 10 is an exploded perspective view of the components of FIG. 9.

FIGS. 9 and 10 illustrate an alternative bobbin latch means 80 for use when winding light tension threads or wire. Latch 80 is mounted in a slot 84 in end portion 52 and an idler roller 82 is provided on the end of the latch means 80 for rotation on a threaded fitting 83 to effect a light engagement with the outer free end of the bobbin member. The slot 84 is of sufficient size to permit the idler 82 to be positioned in the slot when the latch is moved to its depressed position while the bobbin is being placed on the shaft or being removed from the shaft. Otherwise, the embodiment of FIGS. 9 and 10 is essentially identical to the structure of FIGS. 7 and 8. In addition to permitting light winding tension, the embodiment of FIGS. 9 and 10 prevents marring or scarring of the bobbin end face to consequently prolong the useful life of the bobbin.

Figure 6:
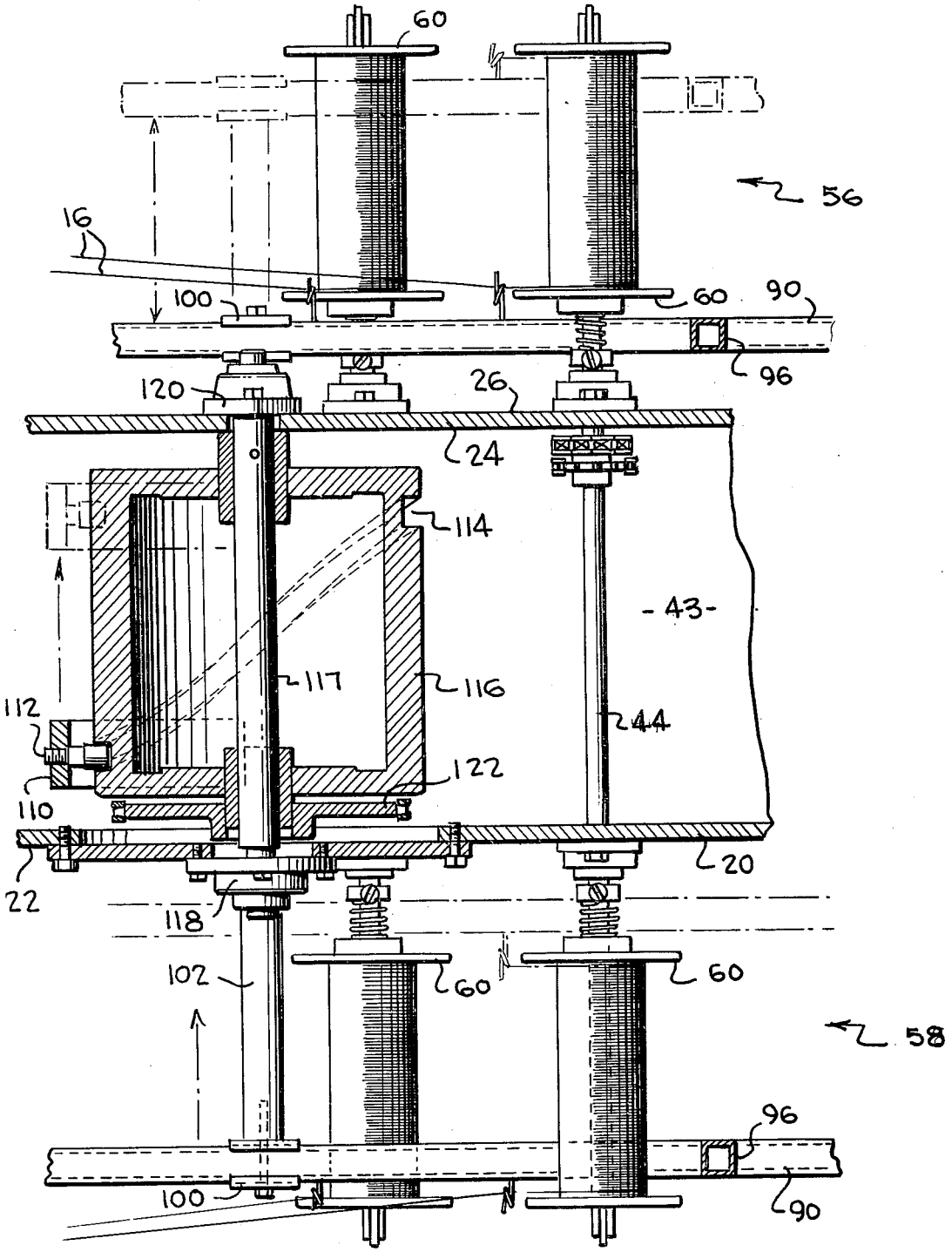
FIG. 6 is a sectional view taken along lines 6—6 of FIG. 3.

A front thread guide support frame consisting of horizontal rods 86, 88, 90 and 92 (FIG. 3) and vertical rods 94 and 96 is provided adjacent the bobbins of the front bank of bobbins 56 and a similar frame is provided adjacent the bobbins of the rear bank of bobbins 58. The thread guide frames are connected by connector members 100 on horizontal rods 88 and 90 to reciprocating support rods 102 illustrated in FIG. 4. The reciprocating support rods 102 are mounted in slide bearings 106 for axial reciprocation and are connected to a cam follower yoke 110. A stud 112 on the yoke 110 extends into a continuous closed slot or groove 114 formed in the surface of a barrel cam member 116 as best illustrated in FIGS. 4, 5 and 6. Support for barrel cam 116 is provided by a cam support shaft 117 mounted in front bearings 118 in the front panel 20 and a rear bearing 120 on the rear panel 24 with a cam drive sprocket 122 also being provided on shaft 117 for effecting rotation of the barrel cam.

Rotation of barrel cam 116 effects movement of the cam follower 110 back and forth along the path between the solid line and dotted line positions of FIG. 6 is an obvious manner with such reciprocation being conveyed to the reciprocable support rods 102 so that both of the thread guide frames are also reciprocated in unison between the solid line and dotted line positions illustrated in FIG. 6.

Figure 3:
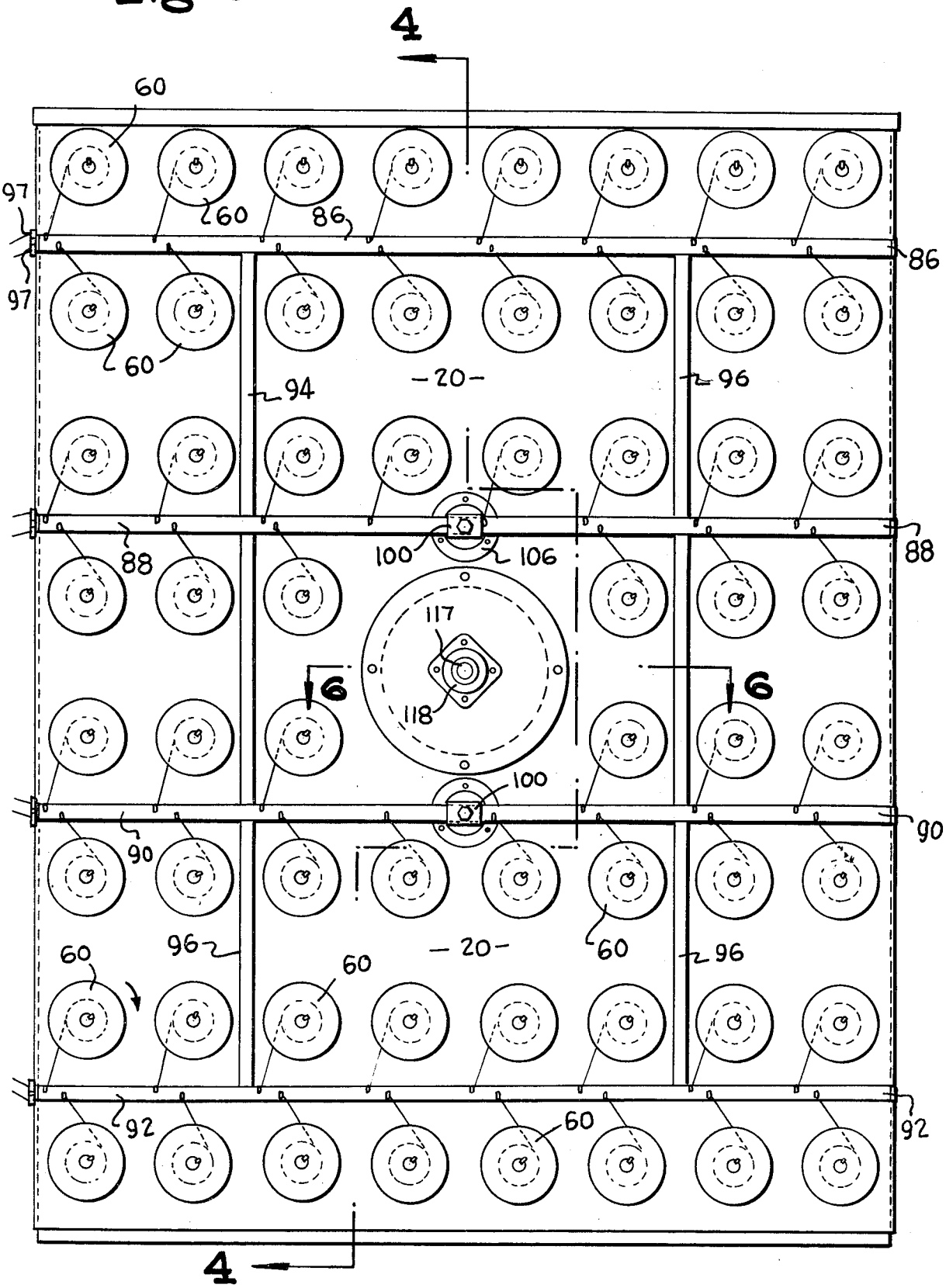
FIG. 3 is an enlarged front elevation view of the preferred embodiment.

A main input thread guide frame consisting of first and second guide bars 97 is provided the ends of horizontal rods 86, 88, 90 and 92 with each of the guide bars having a plurality of thread receiving apertures 98. FIGS. 11 and 12 illustrate the guide bars mounted on horizontal rod 86; however, it is to be understood that the guide bars mounted on the other horizontal rods are mounted in exactly the same manner. The number of apertures in each of the bars 97 is equal the number of bobbins in the upper horizontal row of bobbins as illustrated in FIG. 3. It should be noted that the horizontal guide 86 is provided with a plurality of pigtail guides 99 and the rod extends between the two uppermost horizontal rows of bobbins 60 with each of the individual pigtail guides being associated with one of the bobbins for directing thread 16 thereto. The thread passes through one of the apertures 98 and is then directed to its respective pigtail guide 99 from which it is directed to its respective bobbin member 60. Thread 16 is positionable in the openings 98 by movement through a canted slot 98' provided through the guide bars 97 for each of the openings 98.

FIGS. 13 and 14 illustrate an alternative guide arrangement in which a guide plate 97' is connected to the end of the horizontal guide rod 86 (as well as to the upper horizontal guide rod 88, 90 and 92) and is provided with a plurality of ceramic guides 98" each in the form of a tube through which an individual thread member 16 extends in the same manner as the threads extend through the openings 98 of the embodiment of FIG. 11. This guide assembly is of particular use when feeding thread or the like members having abrasive character which would tend to wear the guide bars of the first embodiment.

All of the bobbin support shafts have at least one drive sprocket 45 for effecting rotation of the shafts from a main power input shaft 44' driven by a drive input chain 130 extending through an opening in side panel 30 from an external power source. Main input shaft 44' additionally includes three output sprockets connected to chains 132, 142 and 150 for a purpose to be discussed. Most of the shafts 44 are provided with a second sprocket for effecting a driving connection through a chain to an adjacent bobbin shaft.

More specifically, rotation of shaft 44' drives the left lowermost one of the shafts 44 (the lowest shaft of the left vertical row of shafts) in FIG. 5 by means of a chain 132 connected to a sprocket 133 keyed on said shaft. The remaining seven bobbin shafts 44 of the left vertical row of bobbin shafts and the uppermost shaft of the second vertical row of bobbin shafts of FIG. 5 are driven from the lower left shaft 44 by a series of power transmission chains consisting of chains 134, 135, 136, 137, 138, 139, 140 and 141 and associated sprockets in an obvious manner. Similarly, rotative power for the six bobbin shafts 44 positioned immediately upward above shaft 44' in the second vertical row of bobbin shafts and the two upper shafts of the third vertical row of bobbin shafts are driven by chains 142, 143, 144, 145, 146, 147, 148 and 149 engaging sprockets on these shafts. The lowermost shaft of the third vertical row of shafts is driven by shaft 44' via chain 150 which in turn provides an output drive through chain and sprocket drives to the shafts in a manner that will be apparent from inspection of FIG. 5.

Additionally, the lower shaft of the third vertical row of shafts driven by chain 150 is drivingly connected to a stepdown chain drive power transmission system for rotating the barrel cam 122. The step-down chain drive power transmission consists of a chain 170 connected to the larger sprocket of a double sprocket 172 mounted for free rotation on the shaft 44 immediately above the lowermost shaft of the third vertical row with the smaller output sprocket of the double sprocket 172 being connected to a chain 180 which is in turn connected to the large sprocket of a double sprocket 182 mounted for free rotation on the next above shaft and having a small output sprocket 185 over which a chain 187 extends with the opposite end of chain 187 extending about the cam drive sprocket 122. Consequently, the barrel cam 116 will be relatively slowly rotated for effecting reciprocation of the thread guide frames by cam follower means 110.

Additionally, it will be appreciated that rotation of the lower shaft of the third vertical row of shafts 44 drives the second from bottom shaft of the third vertical row by means of a double sprocket 191 and chain 190. The double sprocket 191 drives a chain 192 extending about a double sprocket keyed on the third from bottom shaft 44 of the third vertical row of bobbin shafts. The fourth, fifth and sixth bobbin shafts of the third vertical row and the top three shafts of the fourth vertical row of bobbin shafts are driven by chains 194, 196, 198, 200, 202 and 204 extending about sprockets keyed to the respective shaft members. Sprockets 172 and 182 for driving the cam drive sprocket 122 are capable of rotation about the respective shafts 44 on which they are mounted so as to permit these sprockets and the respective shafts to rotate at different angular velocities.

Power from the lowermost shaft 44 of the third vertical row of shafts is conveyed to the lowermost shafts of the fourth, fifth, sixth, seventh and eighth vertical row by chains 210, 212, 214, 216 and 218 extending about sprockets keyed to the various shaft members. Power for rotating the second and third from bottom shafts of the fourth and fifth vertical rows is provided by chains 220, 222, 224 and 226 extending about sprockets on the respective bobbin shafts of these rows. Chains 230, 232, 234, 236, 238, 240, 242 and 244 provide driving power from the lower shaft 44 of the sixth vertical row to the five shafts of the same row immediately above the lowermost shaft and to the three uppermost shafts of the fifth vertical row as shown in FIG. 5. Similarly, chains 246, 248, 250, 252, 254, 256, 258 and 260 provide power from the lowermost shaft 44 of the seventh vertical row of bobbin shafts to the five shafts of the same row immediately thereabove and to the two uppermost shafts of the sixth row of shafts. The upper seven shafts of the eighth vertical row of shafts are driven along with the uppermost shaft of the seventh vertical row by drive chains 262, 264, 266, 268, 270, 272, 274 and 276.

Consequently, the input drive from the main power input chain 130 serves to rotate all of the bobbin support shafts 44 at the same angular speed in unison and to also rotate the barrel cam 116 at a slow rate of rotation for effecting reciprocation of the thread guide frames to provide an even feed of thread 16 to the various bobbins in an obvious manner. Additionally, it should be noted that the arrangement of the bobbins and the various drive components provides a structure which occupies a minimum amount of space and which presents the bobbins in a position at which they are easily accessible. Moreover, all of the drive components are enclosed in the housing 18 so as to protect the workers using the device from possible accidental injury.

It should be understood that the term "thread" as used throughout this application in the specification and claims is used in its broadest generic sense and the invention can be used for winding a wide variety of items such as wire, yarn, etc. and is consequently not limited to any specific type of material to be wound. Moreover, numerous modifications of the preferred embodiment will undoubtedly occur to those of skill in the art; for example, a belt drive system can be employed in place of the chain drives to the various rollers; the number and arrangement of bobbin supporting shafts can be varied in accordance with the particular needs of a user; therefore, it should be understood that the spirit and scope of the invention is to be limited solely by the appended claims.

I claim:

1. A thread winding system comprising a main support means, a plurality of bobbin supporting members on said main support means for supporting a plurality of bobbins for rotation about parallel horizontal axes of rotation, at least one bobbin mounted on each end of said bobbin support means, bobbin drive means for rotating said bobbins about their respective axes of rotation, an individual thread guide positioned adjacent each of said bobbins for guiding a respective thread to its respective bobbin to be wound thereon, thread guide support means supporting said individual thread guides for reciprocation adjacent their respective bobbins and thread guide support drive means for reciprocating said individual thread guides in unison on a path parallel to said axes of rotation, wherein said bobbin support means includes a plurality of bobbin support shafts each having coaxial first and second shaft end portions each respectively extending in opposite directions from said main support means and each shaft end portion respectively supporting a bobbin for rotation, said shafts being arranged in horizontal and vertical rows, said main support means comprises a vertically extending support column housing having a front panel, a rear panel and an internal chamber defined between said front panel and said rear panel, said bobbin shafts including a central shaft portion extending through said internal chamber with said shaft end portions extending outwardly of said front and rear panels, said bobbin drive means includes power transmitting closed loop type flexible drive means mounted in said internal chamber drivingly connecting said bobbin shafts and said thread guide support means comprises a rigid thread guide support frame consisting of a set of vertical rods and a set of horizontal rods respectively extending between said horizontal and vertical bobbin shaft rows.

2. The invention of claim 1 wherein said thread guide support drive means comprises cam means mounted for rotation in said internal chamber and cam follower means engaging said cam and connected to said thread guide support frame.

3. The invention of claim 2 wherein said cam means comprises a barrel cam mounted for rotation about a horizontal axis on shaft means extending between said front panel and said rear panel and cam drive means connecting said barrel cam to a source of power for rotating said barrel cam.

4. The invention of claim 3 wherein said individual thread guides comprise pigtail type guide members and additionally including multi-thread guide means mounted on and adjacent one end of each of said horizontal rods for receiving a plurality of threads from a thread source and directing individual thread members to a specific one of said pigtail type guide members.

5. The invention of claim 4 wherein said multi-thread guide includes an upper row of individual thread guide openings for directing thread members to a row of bobbins positioned above the horizontal rod on which the multi-thread guide is mounted and a lower rod of individual thread guide openings for directing thread members to a row of bobbins positioned beneath the rod on which the multi-thread guide is mounted.

6. The invention of claim 5 wherein said individual thread guide openings are formed in ceramic elements mounted on a supporting plate.

7. A thread winding system comprising a main support means, a plurality of bobbin supporting members on said main support means for supporting a plurality of bobbins for rotation about parallel horizontal axes of rotation, at least one bobbin mounted on each of said bobbin support means, bobbin drive means for rotating said bobbins about their respective axes of rotation, an individual bobbin thread guide positioned adjacent each of said bobbins for guiding a respective thread to its respective bobbin to be wound thereon, thread guide support means supporting said individual bobbin thread guides for reciprocation adjacent their respective bobbins and thread guide support drive means for reciprocating said individual thread guides in unison on a path parallel to said axes of rotation, wherein said bobbin supporting members comprise a plurality of parallel bobbin support shafts, rotary bearing means engaging and supporting each of said bobbin support shafts at a central portion of said shafts so that each of said shafts has outer end portions extending outwardly in opposite directions in a cantilever manner from said rotary bearing means and wherein one of said bobbin members is mounted on each of said outer end portions, additionally including friction drive means mounted on each of said outer end portions of said bobbin support shafts engagable with a bobbin mounted thereon for drivingly rotating said bobbin and further including bobbin latch means comprising a pivotal latch member mounted adjacent the extreme outer end portion of each of said shafts to engage the end of a bobbin carried thereon, wherein said bobbin support shafts are arranged in horizontal and vertical rows, said main support means comprises a vertically extending support column housing having a front panel, a rear panel and an internal chamber defined between said front panel and said rear panel, said bobbin shafts including a central shaft portion extending through said internal chamber with said shaft end portions extending outwardly of said front and rear panels, said bobbin drive means includes power transmitting chain means mounted in said internal chamber drivingly connecting a source of power to sprocket means on said bobbin shafts and said thread guide support means comprises front and rear rigid frame members respectively positioned adjacent the front and back panels and each consisting of a set of vertical rods and a set of horizontal rods respectively extending between said horizontal and vertical rows of bobbin shafts.

8. The invention of claim 7 wherein said thread guide support drive means comprises cam means mounted for rotation in said internal chamber and cam follower means engaging said cam and connected to said first and second rigid frame members for reciprocating said rigid frame members in a direction parallel to the axes of said bobbin support shafts.

9. The invention of claim 8 wherein said cam means comprises a barrel cam, a horizontal shaft extending between said front panel and said rear panel and chain drive means connecting said barrel cam to a source of power.

10. The invention of claim 9 wherein said individual thread guides comprise pigtail type guide members and additionally including multi-thread guide means mounted on and adjacent one end of each of said horizontal rods for receiving a plurality of threads from a thread source and directing individual thread members to a specific one of said pigtail type guide members.

11. The invention of claim 10 wherein said multi-thread guide includes an upper row of individual thread guide openings for directing thread members to a row of bobbins positioned above the horizontal rod on which the multi-thread guide is mounted and a lower row of individual thread guide openings for directing thread members to a row of bobbins positioned adjacently beneath the rod on which the multi-thread guide is mounted.

12. The invention of claim 11 additionally including an idler roller mounted on the pivotal latch members to engage said bobbins with a rolling contact.

13. A thread winding system comprising a vertically extending support member, a plurality of parallel horizontal shaft members arranged in horizontal and vertical rows, rotary bearing means in said support member engaging and supporting said shaft members at a central portion of said shaft member, a bobbin mounted on each end of each of said shaft members outwardly of said central portion to define first and second bobbin banks respectively on opposite sides of said support member, thread guide means for providing an even feed of traveling thread to each of said bobbin members, drive means for rotating said shaft members in unison, a barrel cam mounted for rotation about a horizontal axis in said support member centrally of the vertical and horizontal rows of shaft members, wherein said thread guide includes first and second guide frames each respectively associated with one of said bobbin banks and supporting an individual bobbin thread guide adjacent each of said bobbins with a thread extending through each of said individual bobbin thread guides to the adjacent bobbin and cam follower means engaged with said barrel cam and connecting said first and second guide frames for reciprocating said guide frames to provide an even feed of thread to said bobbins and additionally including a multi-thread guide plate mounted on each of said guide frames between two adjacent horizontal rows of bobbin members including a plurality of thread guide apertures each receiving and guiding a thread to one of the individual bobbin thread guides of the bobbins of the last-mentioned two horizontal rows.

14. The invention of claim 13 wherein said multi-thread guide includes an upper group of individual thread guide openings for directing thread to the bobbins of the uppermost row of the two adjacent horizontal rows of bobbin members and a lower group of individual thread guide openings for directing thread to the bottom of the lowermost row of the two adjacent horizontal rows of bobbin members.

* * * * *

UNITED STATES PATENT AND TRADEMARK OFFICE

CERTIFICATE OF CORRECTION

PATENT NO. : 4,157,793

DATED : June 12, 1979

INVENTOR(S) : Jack Santa Lucia

It is certified that error appears in the above-identified patent and that said Letters Patent are hereby corrected as shown below:

The inventor's name on the cover page of the patent should read:

Jack Santa Lucia

Signed and Sealed this

*Twenty-eighth* Day of *October 1980*

[SEAL]

*Attest:*

SIDNEY A. DIAMOND

*Commissioner of Patents and Trademarks*

*Attesting Officer*